US008303813B2

(12) United States Patent
Coleman

(10) Patent No.: US 8,303,813 B2
(45) Date of Patent: Nov. 6, 2012

(54) WATER FILTER REMOVAL AND INSTALLATION TOOL

(75) Inventor: Joseph Lee Coleman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/196,940

(22) Filed: Aug. 3, 2011

(65) Prior Publication Data

US 2011/0284096 A1 Nov. 24, 2011

Related U.S. Application Data

(62) Division of application No. 11/612,893, filed on Dec. 19, 2006, now Pat. No. 8,001,801.

(51) Int. Cl.

| | |
|---|---|
| ***B01D 35/30*** | (2006.01) |
| ***B01D 29/00*** | (2006.01) |
| ***B01D 27/00*** | (2006.01) |

(52) U.S. Cl. ..... 210/232; 210/238; 210/237; 210/416.3

(58) Field of Classification Search ..... None
See application file for complete search history.

(56) References Cited

U.S. PATENT DOCUMENTS

| | | | | |
|---|---|---|---|---|
| 4,836,065 | A * | 6/1989 | Setliff | 81/124.2 |
| 6,058,813 | A * | 5/2000 | Bryant et al. | 81/176.15 |
| 6,120,685 | A * | 9/2000 | Carlson et al. | 210/232 |
| 2005/0161394 | A1 * | 7/2005 | Fritze et al. | 210/435 |

* cited by examiner

*Primary Examiner* — Benjamin Kurtz
(74) *Attorney, Agent, or Firm* — Kirk W. Goodwin; Diederiks & Whitelaw PLC

(57) ABSTRACT

The present invention relates to a refrigerator having a water filter, a water filter housing, a water filter cap, and a tool for rotating the water filter cap. Engagement of the tool and the water filter cap and subsequent rotation of the tool thereby rotates the water filter cap and water filter. The tool includes a head portion and a body portion and the head portion is an inverse surface of at least a portion of the water filter cap for mating with the water filter cap.

10 Claims, 6 Drawing Sheets

WATER FILTER REMOVAL AND INSTALLATION TOOL

CROSS-REFERENCE TO RELATED APPLICATIONS

This application represents a divisional application of U.S. application Ser. No. 11/612,893, filed Dec. 19, 2006, pending.

BACKGROUND OF THE INVENTION

1. Field of the Invention

The invention relates to a water filter removal and installation tool to replace water filters in a refrigerator without damaging or breaking the water filter cap.

2. Description of Related Art

Water dispensing systems for use in a home refrigerator are commonly known. It is becoming increasingly popular to include a water filter system in a refrigerator to purify the water supplied to the water dispensing system. A typical water filter system includes a water filter, water filter housing and a mechanism for removing the water filter when replacement is required. Water filter systems are provided in various locations in the refrigerator. For example, the water filter may be disposed within the fresh food compartment or mounted beneath the fresh food or freezer compartment, external to the cabinet.

One consideration when designing water filter systems is in utilizing a location that can be easily accessed for replacement directly by consumers. Additionally, the water filter system housing must facilitate easy removal by consumers. Several concepts have been explored in the prior art to address these challenges.

For example, the water filter may be provided within a drawer assembly. The drawer assembly is located below the fresh food or freezer compartment. When the water filter requires replacement, the consumer can easily access the water filter by removing the drawer assembly.

Alternatively, the water filter system may be provided within the fresh food compartment, partially recessed within the ceiling in order to minimize the amount of space it requires. Access is provided to the consumer by a cover that pivots downwardly to provide quick and easy access for replacement.

In another solution, the water filter is provided within a housing and is terminated by a rotatable cap that is accessible to the consumer. Rotation of the cap also rotates the water filter, thereby loosening the filter from the housing. The water filter assembly may be provided below the fresh food or freezer compartment. One problem with this solution is in the difficulty a consumer may have in rotating the cap. Consumers with limited gripping power may not be able to rotate the filter cap. Additionally, consumers may employ pliers or other tools to aid in rotating the cap, which may scratch and deform the cap. Therefore, an improvement over the prior art would be to provide a tool that is designed to aid consumers in rotating the water filter cap.

SUMMARY OF THE INVENTION

Accordingly, the present invention is directed to a water filter removal and installation tool to facilitate the replacement of water filters in a refrigerator.

One embodiment of the invention is a tool for removing and installing a water filter including a head portion and a body portion. The head portion is an inverse surface of at least a portion of a water filter cap.

The body portion could comprise an elongated, generally cylindrical shaft having a textured surface, at least one indentation, or at least one longitudinal channel. Additionally, it could be at least partially covered by a material to facilitate gripping.

In the preferred embodiment of the invention, the water filter cap may be a disc having a protrusion extending across the disc with the outer edges curved convexly towards the protrusion. To mate with the water filter cap, the head portion of the tool may be generally cylindrical and have a slot for mating with the protrusion of the water filter cap. Additionally, the head portion has its outer edges curved concavely towards the slot to match the contour of the water filter cap.

In another embodiment of the invention, the head portion may be removably mounted to the body portion, thereby allowing for interchanging of distinct head portions. Each head portion is an inverse surface of at least a portion of a water filter cap for mating with distinct water filter caps.

Another embodiment of the invention further comprises a handle mounted to the shaft opposite from the head portion.

Another embodiment of the invention further comprises a second head portion mounted to the body portion opposite from the first head portion. The second head portion may be removably mounted to the body portion, thereby allowing for interchanging of distinct second head portions.

In another embodiment, the shaft has the head portion terminally mounted at one end and a protrusion at the opposite end for mating with a second tool.

Another embodiment of the invention is a refrigerator having a water filter, a water filter housing, a water filter cap, and a tool for rotating the water filter cap. Engagement of the tool and the water filter cap and subsequent rotation of the tool thereby rotates the water filter cap and water filter. The tool includes a head portion and a body portion and the head portion is an inverse surface of at least a portion of the water filter cap for mating with the water filter cap.

Additionally, the water filter may be rotatably and removably mounted to the water filter housing and the water filter cap may be removably connected to the water filter.

In another embodiment of the invention, the refrigerator further comprises a base grille, having a receptacle for storing the tool.

The invention further includes a method of rotating a water filter in a refrigerator with a water filter assembly having a water filter cap connected to the water filter. The method includes the steps of engaging a tool with the water filter cap, rotating the tool, and stopping the rotation of the tool at a predetermined position within the water filter assembly. Rotating the tool in one direction facilitates removal of the water filter from the water filter assembly and rotating the tool in an opposite direction facilitates installation of the water filter into the water filter assembly. The method may be used to remove a water filter from the water filter assembly and install a new water filter into the water filter assembly.

The step of stopping the rotation of the tool may occur when the water filter is unable to rotate further within the water filter assembly.

DESCRIPTION OF THE PREFERRED EMBODIMENTS

Figure 1:
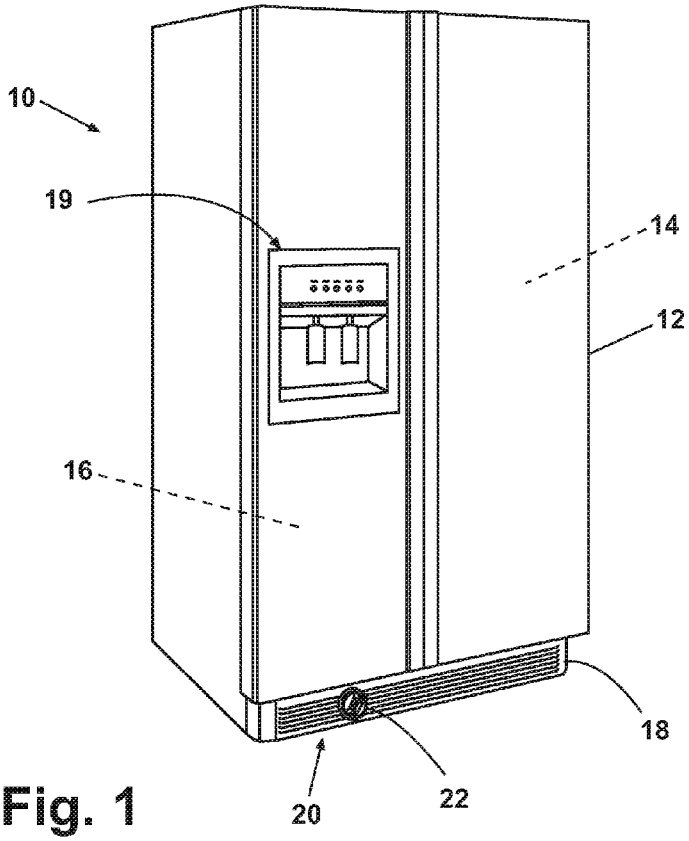
FIG. 1 is a perspective view of a refrigerator having a water filter assembly.

A refrigerator having a water filter assembly will now be described in greater detail with initial reference to the illustrative embodiment of the invention as shown in FIG. 1. A refrigerator 10 is provided with a cabinet 12 forming a fresh food compartment 14 and a freezer compartment 16. A base grille 18 is mounted below the fresh food compartment 14 and freezer compartment 16 wherein a water filter assembly 20 may be housed. The water filter assembly 20 is preferably terminated by a water filter cap 22, which is accessible to a user via an opening in the base grille 18. The water filter assembly is operably connected to a water dispensing system 19, which dispenses filtered water to a user. The refrigerator may be a side-by-side refrigerator as shown in FIG. 1 or may be a top-mount, or bottom-mount refrigerator.

The water filter assembly 20 is further explained with reference to FIGS. 2, 3 and 4. The water filter assembly 20 generally comprises a water filter 26 for filtering water before it is dispensed by the water dispensing system 19, a water filter cap 22 to aid in removal of the water filter 26 and a water filter housing 24, which typically encloses the water filter 26 and interfaces with the water dispensing system 19. Each of these subsystems will be explained in detail in the following sections.

Figure 2:
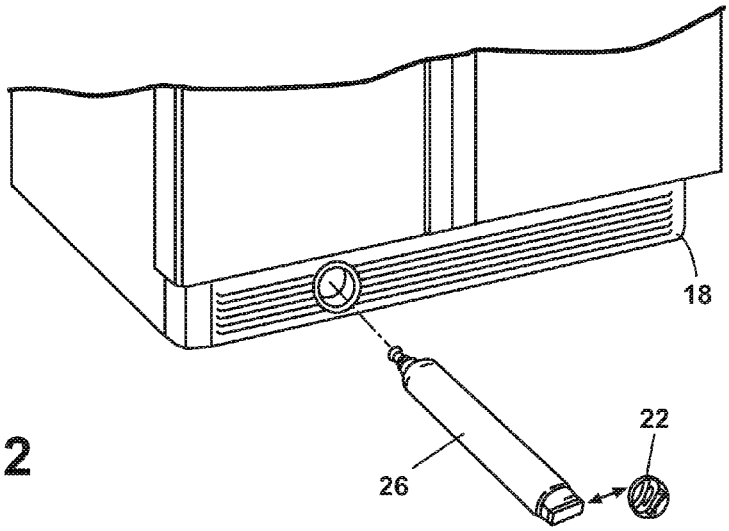
FIG. 2 is an exploded fragmentary perspective view generally illustrating the installation of a water filter and water filter cap into the water filter assembly.

FIG. 2 illustrates the installation of the water filter 26 and water filter cap 22 into the water filter housing 24, which may be provided within the base grille 18. In the preferred embodiment, the water filter cap 22 is removably mounted to the water filter 26. In combination, the water filter cap 22 and water filter 26 are inserted into the water filter housing 24 via an opening in the base grille 18. To secure the cap and filter in the water filter housing 24, the water filter cap 26 is rotated until the water filter 26 reaches a predetermined position within the water filter housing 24. To install the water filter 26, the water filter cap 22 may be rotated either clockwise or counterclockwise. To remove the water filter 26, the water filter cap 22 is rotated in the opposite direction.

Figure 3:
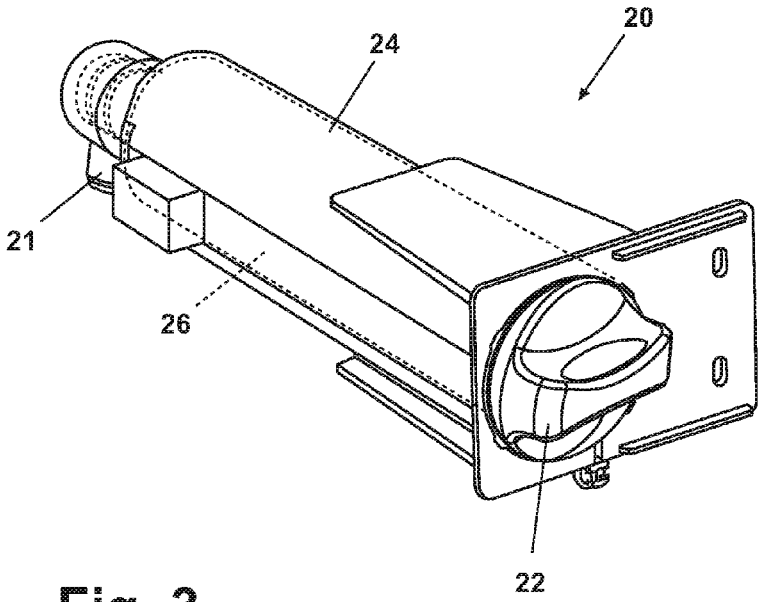
FIG. 3 is a perspective view of a water filter assembly.
Figure 4:
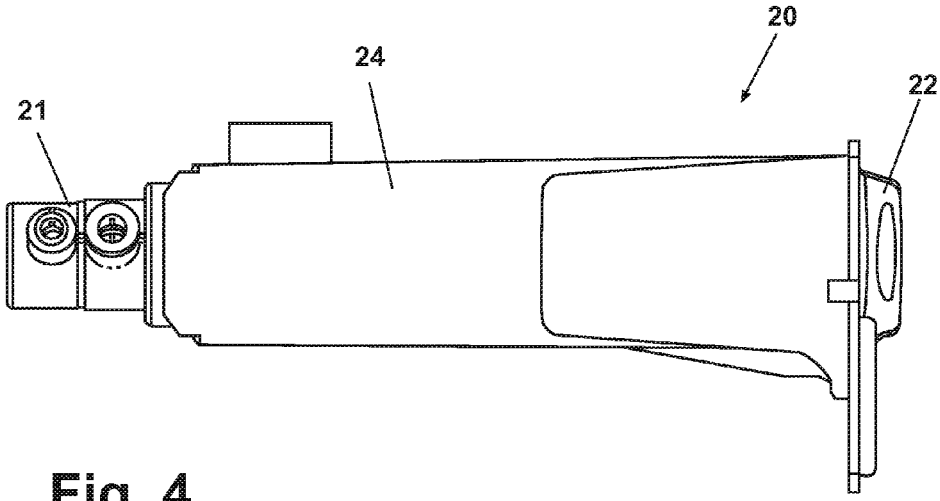
FIG. 4 is a side view of the water filter assembly.

FIGS. 3 and 4 further illustrate the water filter assembly 20. In the preferred embodiment, the water filter housing 24 may match the shape of the water filter 26, as shown by the cylindrical water filter housing 24 in FIGS. 3 and 4. One end of the water filter housing 24 is terminated by an interface to a water dispensing system 21 and may include tabs to engage and secure the water filter 26 when rotated within the water filter housing 24. The opposite end of the water filter housing 24 has an access opening for inserting the water filter 26. The water filter housing 24 may be mounted horizontally within the base grille 18. In other embodiments, the water filter housing 24 may be provided within the fresh food compartment 14 or in a drawer assembly to aid in removal of the water filter 26.

Figure 5:
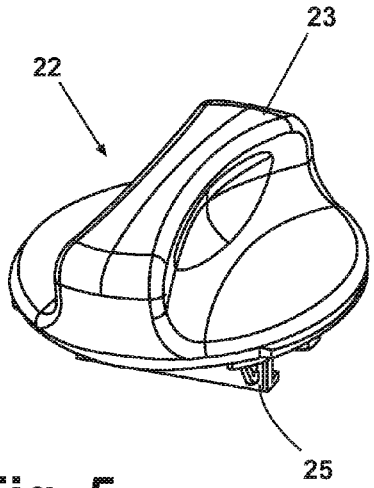
FIG. 5 is a perspective view illustrating an embodiment of a water filter cap.
Figure 6:
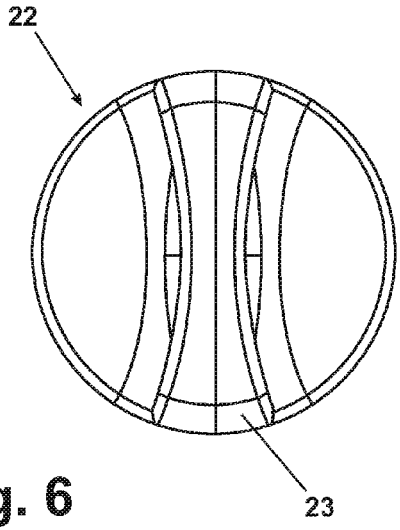
FIG. 6 is a top view illustrating an embodiment of a water filter cap.

One embodiment of the water filter cap 22 is shown in FIGS. 5 and 6. The water filter cap 22 may be circular and may comprise at least one protrusion 23 to facilitate rotation of the water filter cap 22. The protrusion 23 may be located in the center of the water filter cap 22 and may extend across the cap, starting at one edge and terminating at the opposite edge. Alternatively, the protrusion may extend across a portion of the water filter cap 22 or may extend beyond the edges of the water filter cap 22. The shape of the protrusion 23 may be a rectangle, an hourglass, a square, an oval, or various other shapes. The sides of the water filter cap 22 adjacent to the protrusion 23 may be flat, sloped, curved, or of various other contours. In the embodiment shown in FIGS. 3 and 4, the sides of the water filter cap 22 are convexly curved towards the protrusion 23 and two of the edges of the protrusion are concavely curved. It can be readily understood that the shape and location of the protrusion, the number of protrusions, and the shape of the sides of the water filter cap 22 could be changed without altering the function of the invention. For example, the protrusion 23 could comprise two offset rectangular knobs extending across half of the water filter cap 22 and would still achieve the desired result.

The water filter cap 22 further comprises a connector portion 25 for mating with the water filter 26. The connector portion 25 may be on the bottom of the water filter cap 22 and may comprise a rectangular slot. Referring again to FIG. 2, to install the water filter cap 22 onto the water filter 26, a user slides the connector portion 25 over a protrusion on the water filter 26. The connector portion 25 may be manufactured together with the water filter cap 22 as one part or may be a separate part connected to the water filter cap 22 by screws, snap-fits or various other fastener configurations, as those of skill in the art are aware.

A problem with the above-described configuration is in the difficulty a user has in rotating the water filter cap 22 within the water filter housing 24. Due to the pressure of the water exerted on the water filter 26, the water filter 26 may become difficult to remove from the water filter housing 24. A user may not have the strength to rotate the water filter cap 22 using his or her hands. Likewise, a user with limited gripping power may not be able to rotate the water filter cap 22 under normal conditions.

To address this problem, a custom tool 30 is provided to facilitate rotation of the water filter cap 22 and thereby the water filter 26 within the water filter housing 24. One embodiment of the tool 30 of the present invention is described with reference to FIGS. 7 and 8. The tool 30 generally comprises a head portion 34 for mating with the water filter cap 22 and a body portion 32 for gripping by a user.

Figure 7:
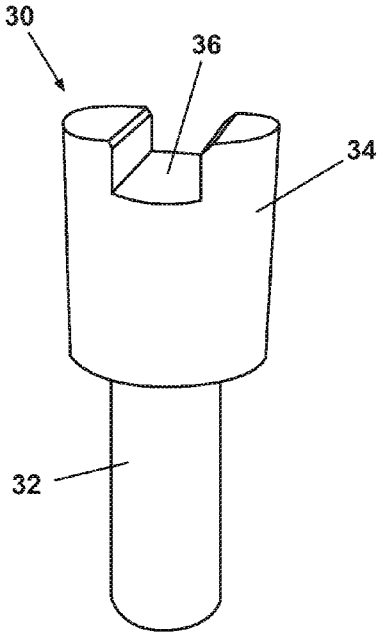
FIG. 7 is a perspective view illustrating a tool for removing and installing a water filter according to a first embodiment of the present invention.
Figure 8:
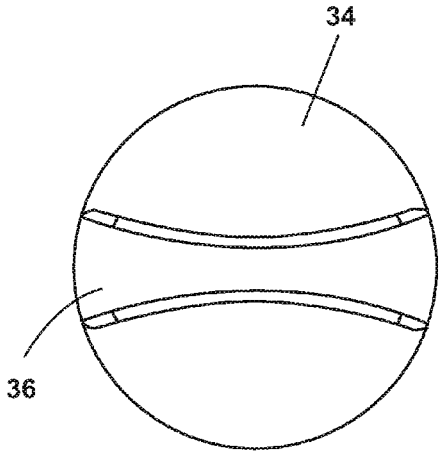
FIG. 8 is a top view illustrating an embodiment of the tool of the present invention.

In the preferred embodiment, the head portion 34 has an inverse surface of at least a portion of a water filter cap 22. The head portion 34 may be of various shapes, such as a circle, as shown in FIG. 8. Alternatively, it may be a square, rectangle, oval, or diamond, or virtually any other shape. Since the head portion 34 mates with the water filter cap 22, the head portion 34 may comprise various configurations to match at least a portion of the top surface of the water filter cap 22. For example, the head portion 34 may have a center slot 36 with the sides concavely curved towards the slot, as illustrated in FIGS. 7 and 8. This embodiment is shown for mating with the embodiment of the water filter cap 22 of FIGS. 5 and 6. Alternatively, the slot 36 may extend partially across the head portion 34 or may be located generally in the center of the head portion 34. The shape of the slot may be a rectangle, an hourglass, a square, and oval, or various other shapes. The sides adjacent to the slot 36 may be flat, sloped, curved, or of various other contours. Additionally, the head portion 34 may comprise an inverse surface of a subsection of the top surface of the water filter cap 22. For example, the head portion 34 may comprise a slot 36 with adjacent sides that mate with a portion of the water filter cap 22. It can be readily understood that the shape and location of the slot, the number of slots, and the shape of the sides adjacent to the slot may be changed without altering the function of the invention, as long as the head portion 34 is an inverse surface of at least a portion of the water filter cap 22, which reduces the likelihood of damaging the water filter cap 22. Thus, various configurations of the head portion 34 are possible for mating with distinct water filter caps 22.

The body portion 32 may be an elongated cylindrical shaft as shown in FIG. 7. In alternative embodiments, the shape of the body portion 32 may be modified to facilitate comfortable gripping. For example, the body portion 32 may have indentations to accommodate one or more fingers or may have channels extending longitudinally thereon. The body portion 32 may further comprise a textured surface to increase gripping stability. For example, the surface of the body portion 32 may be knurled, grooved, ribbed, ridged, or of various other textures, as those of skill in the art are aware. In another embodiment of the invention, a material to facilitate gripping may at least partially cover the body portion 32. The material may be rubber, gel, neoprene, or a number of other materials to increase a user's comfort when gripping the body portion 32. The material may completely enclose the body portion 32 or may partially enclose the body portion 32, such as by covering indentations where a user's fingers may be placed. The size and shape of the body portion 32 of the present invention may be changed and still achieve the desired result.

Figure 9:
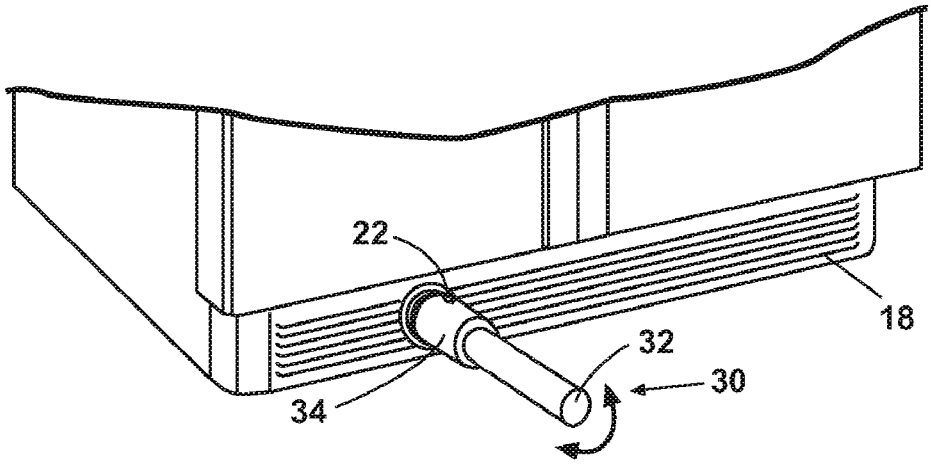
FIG. 9 is an exploded segmented perspective view of the tool preparing to engage a water filter cap.

FIG. 9 illustrates the use of the tool 30 to rotate the water filter cap 22 and thereby remove the water filter 26 from the water filter housing 24. First, a user engages the tool 30 with the water filter cap 22. While gripping the body portion 32, the user rotates the tool 30 until the water filter 26 reaches a predetermined position within the water filter housing 24. The tool 30 may be rotated in a clockwise or counterclockwise direction. Once the water filter 26 is loose, the user can remove it from the water filter housing 24. A similar method is used for installing the water filter 26 into the water filter housing 24. First, a user inserts the water filter 26 into the water filter housing 24 and engages the tool 30 with the water filter cap 22. While gripping the body portion 32, the user rotates the tool 30 in an opposite direction from the direction used when removing the water filter 26. The tool 30 is rotated until the water filter 26 reaches a predetermined position within the water filter housing 24.

The tool 30 is advantageous for several reasons. First, the head portion 34 may be manufactured to mate with any number of water filter caps. Thus, the design is adaptable to many refrigerator platforms having different water filter caps. Additionally, since the tool 30 is an inverse surface of at least a portion of the water filter cap 22, the tool 30 is less likely to damage the water filter cap 22. Finally, the tool 30 increases the likelihood of a user removing the water filter 26 more easily and comfortably.

In a second embodiment of the invention, the head portion 34 may be removably mounted to the body portion 32, which allows for interchanging of distinct head portions for mating with various water filter caps. The head portion 34 may comprise an inverse surface of at least a portion of a water filter cap 22. As described previously, the shape and geometry of the head portion 34 may vary without altering the function of the invention as long as the head portion 34 is an inverse surface of at least a portion of the water filter cap 22. Alternatively, the head portion 34 may be a tool with application elsewhere in the refrigerator 10. For example, the head portion 34 could comprise a brush or plurality of fingers for cleaning the base grille 18. The body portion 32 may have various shapes and configurations to facilitate gripping without altering the function of the invention.

The head portion 34 could be removably mounted to the body portion 32 in a variety of ways. For example, an end of the body portion 32 may be threaded, while the head portion 34 may have a cavity wherein the inner walls of the cavity are likewise threaded for mating with said body portion. In another embodiment, the body portion 32 may comprise a protrusion of ramped tabs to engage with ramped surfaces on the head portion 34. To secure the head portion 34 to the body portion 32, a user engages the head portion 34 with the body portion 32 and rotates the head portion 34 until it is unable to rotate further, thereby locking in place. There are additional configurations for removably mounting the head portion 34 to the body portion 32, as those of skill in the art are aware.

Figure 10:
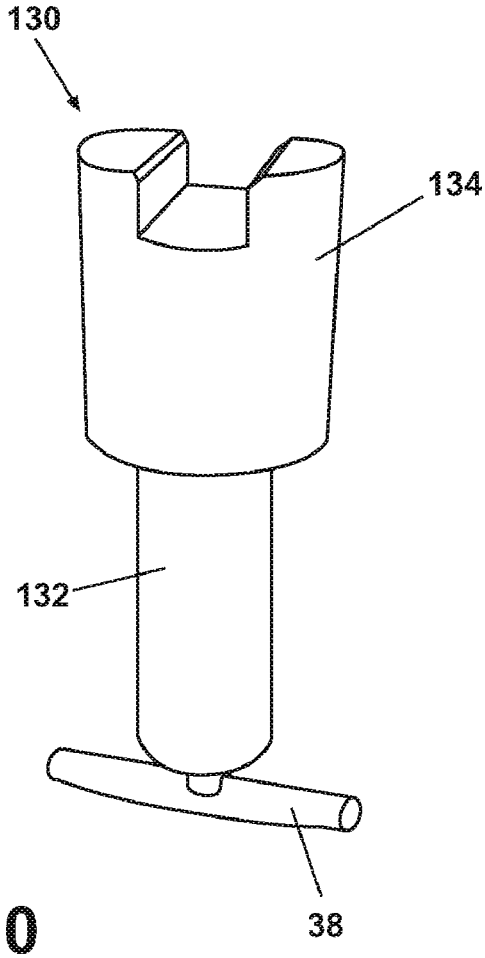
FIG. 10 is a perspective view illustrating a tool for removing and installing a water filter according to a second embodiment of the present invention.

FIG. 10 discloses an alternative embodiment of the tool 130. In this embodiment, the body portion 132 further comprises a handle grip 38 mounted opposite from the head portion 134 to further ease rotation of the water filter cap 22. The shape of the handle grip 38 may be generally cylindrical, rectangular, ovular, or of various other shapes and may comprise a rounded or flat surface. Furthermore, the handle grip 38 may be modified to facilitate comfortable gripping. For example, the handle grip 38 may have indentations to accommodate one or more fingers or may have a textured surface to provide additional gripping stability. Additionally, the handle grip 38 may be at least partially covered with a material such as rubber, gel, or neoprene, to increase a user's comfort when gripping the handle grip 38. The handle grip 38 may be manufactured together with the body portion 132 and head portion 130 as one part or may be a separate part removably mounted to the body portion 132. As described previously, the shape and geometry of the head portion 134 may vary without altering the function of the invention as long as the head portion 134 is an inverse surface of at least a portion of the water filter cap 22. Moreover, the head portion 134 may be removably mounted to the body portion 132 to allow for interchanging of distinct head portions. Similarly, the body portion 132 may have various shapes and configurations without altering the function of the invention.

To operate, a user grips the handle grip 38 and engages the tool 130 with the water filter cap 22. While gripping the handle grip 38, the user rotates the tool 130 until the water filter 26 reaches a predetermined position within the water filter housing 24. Similar to previous first embodiments, the tool 130 may be rotated in a clockwise or counterclockwise direction and may be used for both removal and installation of the water filter 26.

Figure 11:
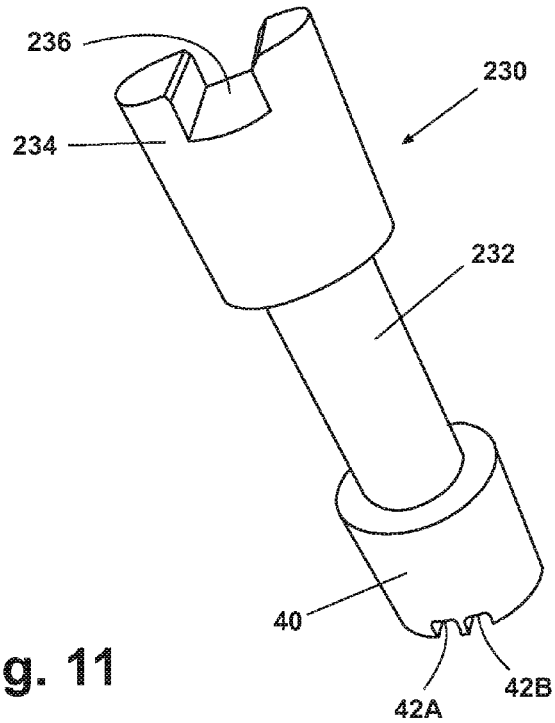
FIG. 11 is a perspective view illustrating a tool for removing and installing a water filter according to a third embodiment of the present invention.

Another embodiment of the tool 230 is shown with reference to FIG. 11. In this embodiment, the tool 230 further comprises a second head portion 40, mounted opposite from the first head portion 234. The second head portion 40 may comprise a second inverse surface of at least a portion of a water filter cap 22 for mating with a different cap or may be a tool with application elsewhere in the refrigerator 10. For example, the second head portion 40 could comprise a brush or plurality of fingers for cleaning the base grille 18. In another embodiment, the second head portion 40 could comprise a tool for rotation of another removable member of the refrigerator 10. The first head portion 234 or the second head portion 40, or both of said head portions may be removably mounted to the body portion 232. As shown in FIG. 11, the second head portion 40 may comprise two slots, 42*a* and 42*b* for mating with a water filter cap and the first head portion 234 may comprise one slot 236 for mating with a different water filter cap. The shape and geometry of the first head portion 234 or the second head portion 40 may vary without altering the function of the invention as long as one of the head portions is an inverse surface of at least a portion of a water filter cap. Similarly, the body portion 232 may have various shapes and configurations to facilitate gripping without altering the function of the invention.

Figure 12:
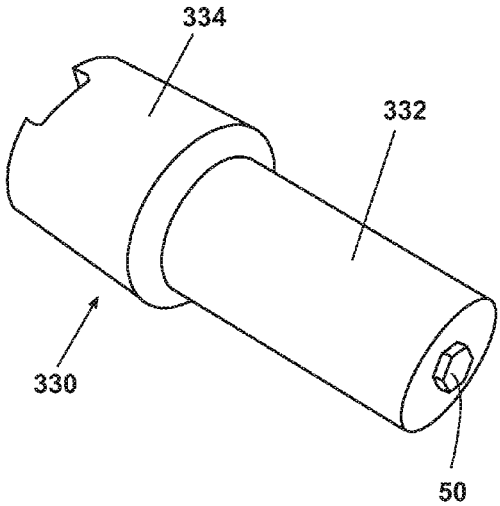
FIG. 12 is a perspective view illustrating a tool for removing and installing a water filter according to a fourth embodiment of the present invention.
Figure 13:
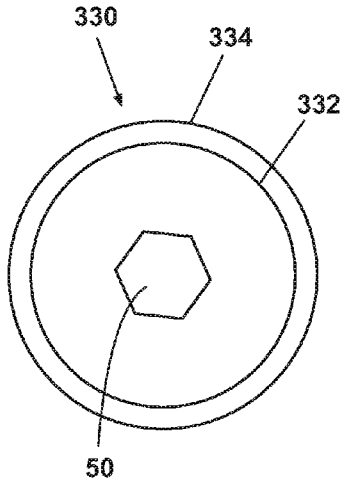
FIG. 13 is a top view illustrating the fourth embodiment of the present invention.
Figure 14:
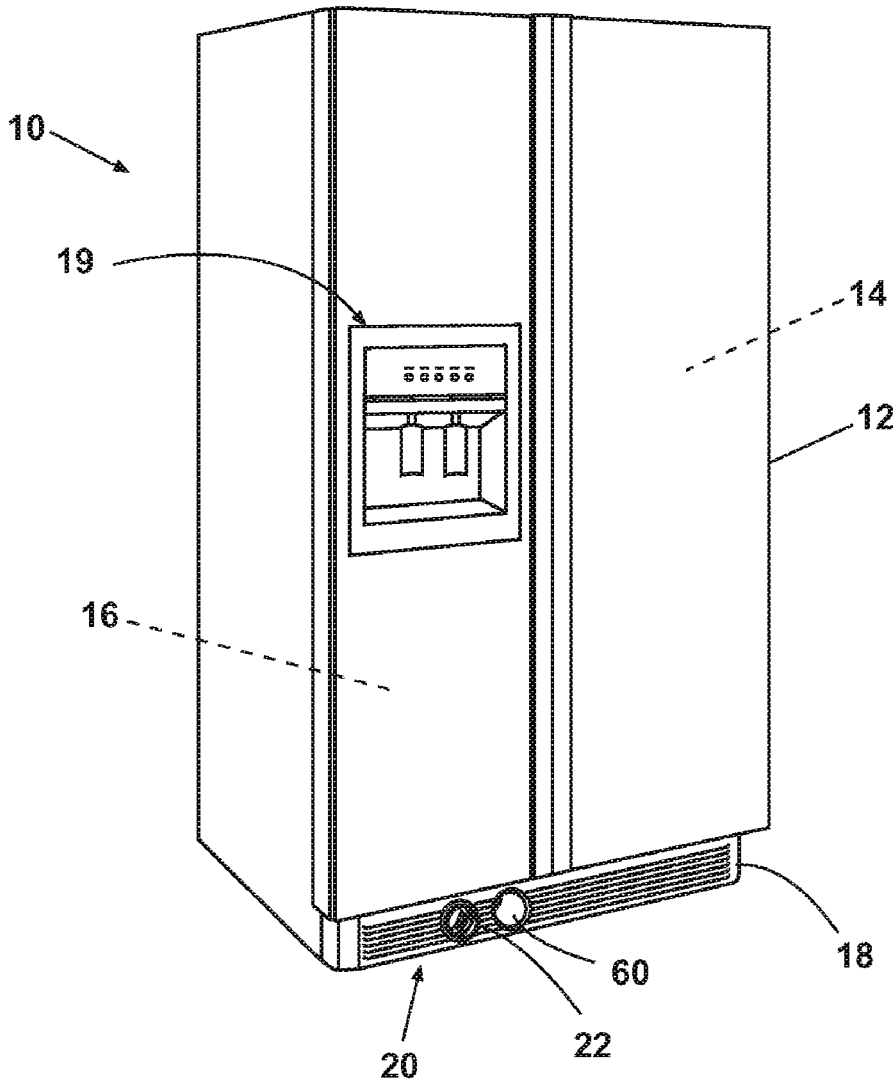
FIG. 14 is a perspective view of a refrigerator having a water filter assembly and a receptacle for housing an embodiment of the tool of the present invention.

FIGS. 12 and 13 disclose another embodiment of the tool 330. In this embodiment, the body portion 332 further comprises a protrusion 50 at an end of the body portion 334 opposite from the end on which the head portion 334 is mounted. The protrusion 50 may be used to engage the tool 330 with another tool, such as a socket wrench, to further ease rotation of the water filter cap 22. The protrusion 50 may be of various shapes, for instance hexagonal, square, or diamond-shaped, for mating with various tools. As described previously, the shape and geometry of the head portion 334 may vary without altering the function of the invention as long as the head portion 334 is an inverse surface of at least a portion of the water filter cap 22. Moreover, the head portion 334 may be removably mounted to the body portion 332 to allow for interchanging of distinct head portions. Similarly, the body portion 332 may have various shapes and configurations without altering the function of the invention.

To operate, a user engages a secondary tool, such as a socket wrench, with the protrusion 50 of the tool 330, which is engaged with the water filter cap 22. While gripping the secondary tool, the user rotates the secondary tool, thereby rotating the tool 330. The user rotates the secondary tool until the water filter 26 reaches a predetermined position within the water filter housing 24. Similar to the previous embodiments, the tool 330 may be rotated in a clockwise or counterclockwise direction and may be used for both removal and installation of the water filter 26.

Referring again to FIG. 1, in another aspect of the present invention, the base grille 18, may further comprise a receptacle 60 for storing any of the embodiments of the tool of the present invention. The receptacle 60 may be located at any position within the base grille 18 that does not interfere with the water filter assembly 20. Alternatively, the water filter housing 24 may be expanded to include a receptacle 60 for storing the tool 30 within the water filter housing 24. The receptacle 60 includes a mechanism for securing the tool 30 within the receptacle 60. For example, the receptacle 60 may include a spring-loaded ejector at the rear of the receptacle 60. When a user inserts the tool 30 into the receptacle 60, the spring compresses and locks, thereby securing the tool 30. To remove the tool 30, a user pushes the tool 30 to release the spring, thereby ejecting the tool. Alternatively, the receptacle 60 may secure the tool 30 using threading within the receptacle 60 to mate with threading on the tool 30, a snap fit assembly, a cam locking feature, or other mechanisms, as those of skill in the art are aware.

While the present invention has been described with reference to the above described embodiments, those of skill in the art will recognize that changes may be made thereto without departing from the scope of the invention as set forth in the appended claims.

What is claimed is:

1. A method of rotating a water filter including a first end, adapted to fluidly connect with a water dispensing system provided in a refrigerator with a water filter housing, and a second end portion, the method comprising the steps of:

mounting a water filter cap onto the second end of the water filter;

engaging a tool with the water filter cap;

rotating the tool, water filter cap and water filter relative to the water filter housing; and stopping rotation of the tool at a predetermined position to alter an engagement state between the first end of the water filter and the water dispensing system.

2. The method of claim 1, wherein rotating the tool in one direction facilitates removal of the water filter from the water filter housing and rotating the tool in an opposite direction facilitates installation of the water filter into the water filter housing.

3. The method of claim 2, wherein the steps are used to remove the water filter from the water filter housing and install a new water filter into the water filter housing.

4. The method of claim 2, wherein the step of stopping the rotation of the tool occurs when the water filter is unable to rotate further within the water filter housing.

5. A method of rotating a water filter relative to a water filter housing provided in a refrigerator including a cabinet defining at least one refrigerated compartment and a water dispensing system comprising:

engaging a head portion of a tool for removing and installing the water filter with a first connector portion of a water filter cap including a second connector portion mounting the water filter cap to one end portion of the water filter;

rotating the tool, through a body portion of the tool, to cause simultaneous rotation of the water filter cap and the water filter relative to both the water filter housing and the cabinet in order to alter a fluid connection between an opposing end portion of the water filter and the water dispensing system.

6. The method of claim 5, wherein engaging the head portion of the tool with the first connector portion of the water filter cap includes positioning a protrusion defining the first connector portion with a slot formed in the head portion, with the slot being defined by surface portions of the head portion configured as inverse to a shape of the protrusion on the water filter cap.

7. The method of claim 6, wherein the water filter cap comprises a disc and the protrusion extends across the disc, with outer edges of the protrusion being curved convexly towards the protrusion.

8. The method of claim 6, further comprising: matching a contour of the water filter cap to outer edges of the head portion of the tool which curve toward the slot.

9. The method of claim 5, further comprising: mating the body portion of the tool, remote from the head portion, with another tool for rotating the tool.

10. The method of claim 5, further comprising:

removing the head portion of the tool from the body portion; and interchanging the head portion with a distinct head portion.

* * * * *